US005229783A

United States Patent [19]

Tilston et al.

[11] Patent Number: 5,229,783

[45] Date of Patent: Jul. 20, 1993

[54] FIELD ADJUSTABLE SECTORAL ANTENNA

[76] Inventors: Stephen E. Tilston; David A. Tilston, both of 500 Van Buren Street, P.O. Box 550, Kemptville, Ontario, Canada, K0G 1J0

[21] Appl. No.: 812,809

[22] Filed: Dec. 24, 1991

[30] Foreign Application Priority Data

Jan. 2, 1991 [CA] Canada ..... 2033496

[51] Int. Cl.[5] ..... H01Q 19/10

[52] U.S. Cl. ..... 343/834; 343/837; 343/818; 343/819

[58] Field of Search ..... 343/834, 817, 818, 841, 343/880, 879, 915, 837, 836

[56] References Cited

U.S. PATENT DOCUMENTS 3,742,513 6/1973 Ehrenspeck ..... 343/817

5,111,214 5/1992 Kumpfbeck et al. ..... 343/817

*Primary Examiner*—Rolf Hille

*Assistant Examiner*—Hoanganh Le

*Attorney, Agent, or Firm*—Dickstein, Shapiro & Morin

[57] ABSTRACT

There is provided a new and useful field adjustable sectoral antenna comprising a flat reflecting surface having a front surface and first and second sides; at least one radiating element mounted in front of the front surface; and a pair of side panels each having front and rear edges and inner and outer surfaces; and wherein the panels are mounted with their inner surfaces along respective ones of the first and second sides of the reflecting surface for forward and rearward sliding movement of the side panels relative to the reflecting surface.

16 Claims, 3 Drawing Sheets f=299.8MHz, L1=L2=0.5m, h=0, S=0.3m f=299.8MHz, L1=L2=0.5, h=0.1m, S=0.3m f=299.8MHz, L1=L2=0.5m, h=0.2m, S=0.3m

FIELD ADJUSTABLE SECTORAL ANTENNA

FIELD OF THE INVENTION

This application relates to sectoral reflector antennas.

BACKGROUND OF THE INVENTION

Sectoral antennas are those which are designed to transmit or receive signals over a selected sector. A recent phenomenon which has highlighted the usefulness of sectoral antennas is the development of cellular telephones. Sectoral antennas are ideally suited for use in a given cellular telephone operating area.

Sectoral antennas have to date generally been adjusted at the factory to obtain the desired pattern. Normally these antennas have not been field adjustable or may be adjustable only with substantial difficulty after installation.

To date only corner reflectors have in some cases been made field adjustable. The relative positions of the sides of the reflector would be changed about the angle by adjusting the dimensions of the sides or changing the angle. These adjustment methods are effective but have been found to be generally undesirable as a result of physical problems. Changes in wind loading on the support structure have created problems with these types of adjustments and, as well, the mechanisms required to change the angle of the corner have been overly complicated for field use.

A substantial operating problem with prior art adjustable antennas has been a difficulty in maintaining an acceptable VSWR over wide band widths. With the corner reflectors adjustment has tended to reduce the useable band width of the antennas. A significant need has arisen for field-adjustable sectoral antennas which will maintain an acceptable VSWR over wide band widths. With the very rapid increase in the use of cellular telephones, the need to be able to adjust existing antennas to meet rapidly changing conditions became evident. No practical means was available for dealing with the problem.

Against this background the present invention provides a field adjustable sectoral antenna which is easily adjusted in the field to provide a wide range of patterns in the horizontal plane, while maintaining an acceptable VSWR over the required band width.

PRIOR ART

Applicant is not aware of any prior patents which suggest a field adjustable antenna structure.

U.S. Pat. No. 3,742,513, issued Jun. 26, 1973, to Ehrenspeck provides for apparent factory adjustment of a side rim to obtain optimum directivity of an antenna. That patent does not relate structurally or conceptually to the present invention.

BRIEF SUMMARY OF THE INVENTION

It has now been determined that a field adjustable antenna meeting required criteria can be constructed by utilizing side panels which are movable relative to the reflecting surface of the antenna to establish a desired horizontal radiation pattern. Thus the invention provides a field adjustable sectoral antenna comprising a flat reflecting surface having a front surface and first and second sides; at least one radiating element mounted in front of the front surface; and a pair of side panels each having front and rear edges and inner and outer surfaces; and wherein the panels are mounted with their inner surfaces along respective ones of the first and second sides of the reflecting surface for forward and rearward sliding movement of the side panels relative to the reflecting surface.

BRIEF DESCRIPTION OF THE DRAWINGS

In drawings which illustrate embodiments of the invention.

Figure 1:
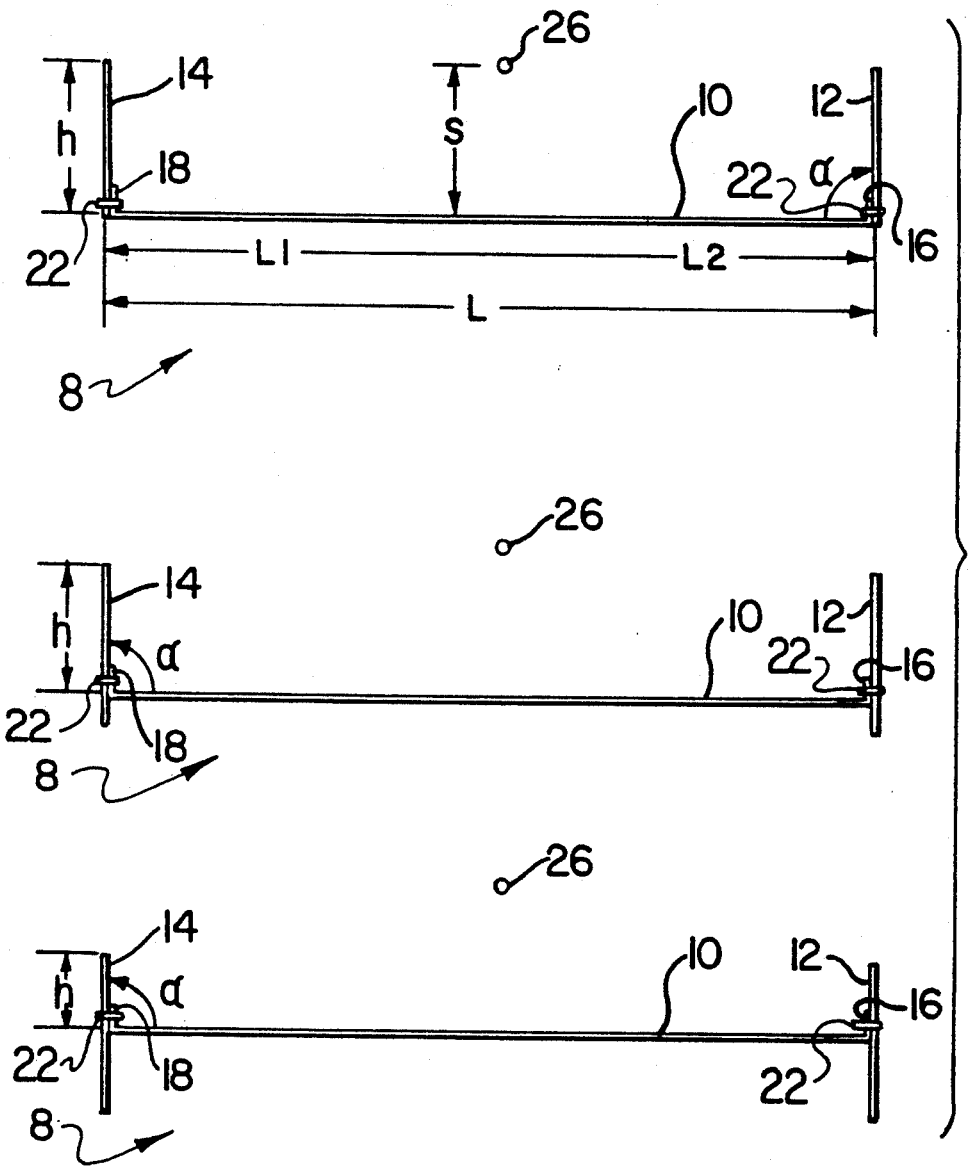
FIG. 1 is a schematic diagram illustrating the adjustability of the antenna of the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Figure 2:
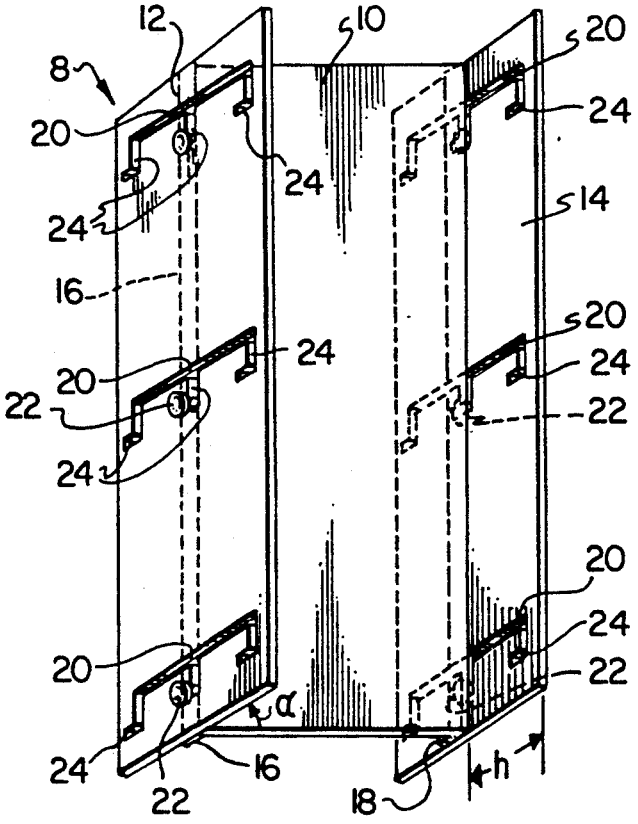
FIG. 2 is a perspective view of an antenna according to the invention.

With reference to FIGS. 1 and 2 there is illustrated a sectoral antenna 8 comprising a flat reflecting surface 10 and a pair of side panels 12 and 14.

The reflecting surface 10 includes a pair of edge flanges 16 and 18. The side panels 12 and 14 are secured to the flanges 16 and 18 of the reflecting surface 10 in such a way as to be slidable front to rear relative to the surface 10.

In the preferred configuration the side panels 12 and 14 include a series of slots 20 extending front to rear. A corresponding series of connecting devices 22, preferably nuts and bolts, is provided for securing the panels 12 and 14 to the flanges 16 and 18 of the reflecting surface 10. The connecting devices 22 may be partially or fully released to allow panels 12 and 14 to be positioned front to rear relative to the reflecting surface 10 by positioning slots 20 in the desired location relative to the connecting devices 22 and then securing the connecting devices and the panels 12 and 14.

In the most preferred case the slots 20 are provided with an integral series of hooked offset slots 24 which allow the panels to be readily adjusted to a uniform and preferred position. In sectoral terms the various offset positions may correspond to preferred sectoral coverage; as, for example, 60°, 90° and 120°.

The angle $\alpha$ between the panels 12 and 14 and the reflecting surface 10 is preferably although not necessarily 90°.

To complete the antenna a radiating element or source 26, usually at least one dipole (not illustrated) is placed in fixed position in front of the reflecting surface 10.

The operation of the antenna can be explained with reference to FIGS. 2 and 3 to 5. The dimensions are chosen to cause direct and reflective radiation to add in phase in a forward direction to thereby focus the energy in a direction away from the reflecting surface 10 and with a desired horizontal pattern. A source 26 is assumed to be isotropic and at a fixed distance S from the surface 10. The diameter L of surface 10 is also taken to be fixed (and in practice preferably 1 wavelength) with source 26 located above the midpoint of surface 10 such that L1 equals L2. The height h of the side panels 12 and 14 is variable.

It should be noted that the height h may be different in respect of the two side panels 12 and 14, depending on the pattern required.

The antenna can be analyzed two-dimensionally without loss of generality, and while exact analytical solution is complex, a number of approximate numerical methods are known for analyzing the structure. One method is as follows.

It is well known that a solid conducting sheet can be closely approximated by a wire grid providing the grid spacing is small in terms of the wave length. Additionally, the grid needs only wires parallel to the direction of polarization of the electromagnetic radiation. Thus in an X, Y, Z coordinate system a Z-directed dipole may be used as the source and closely spaced Z-directed wires as an approximation of the back and side panels. The system may be modelled using either a moment method or by a method of solving the scattering problem for the array of cylinders and the source. Both approaches are addressed by known programs and solutions.

Figure 3:
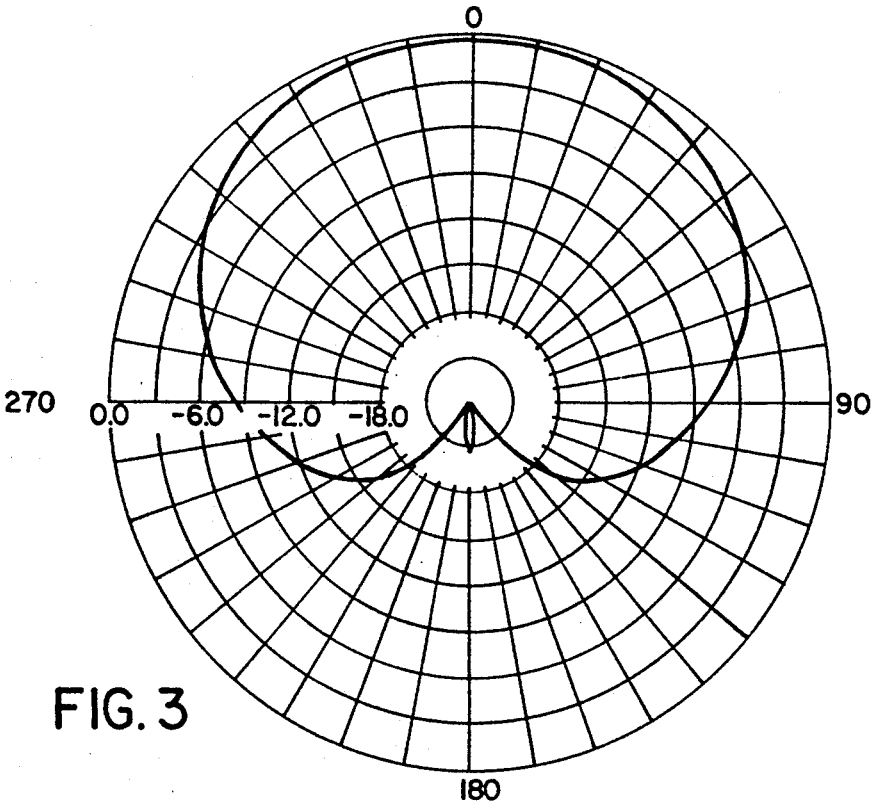
FIGS. 3 to 5 illustrate radiation patterns for different adjustments of the antenna of the invention.
Figure 4:
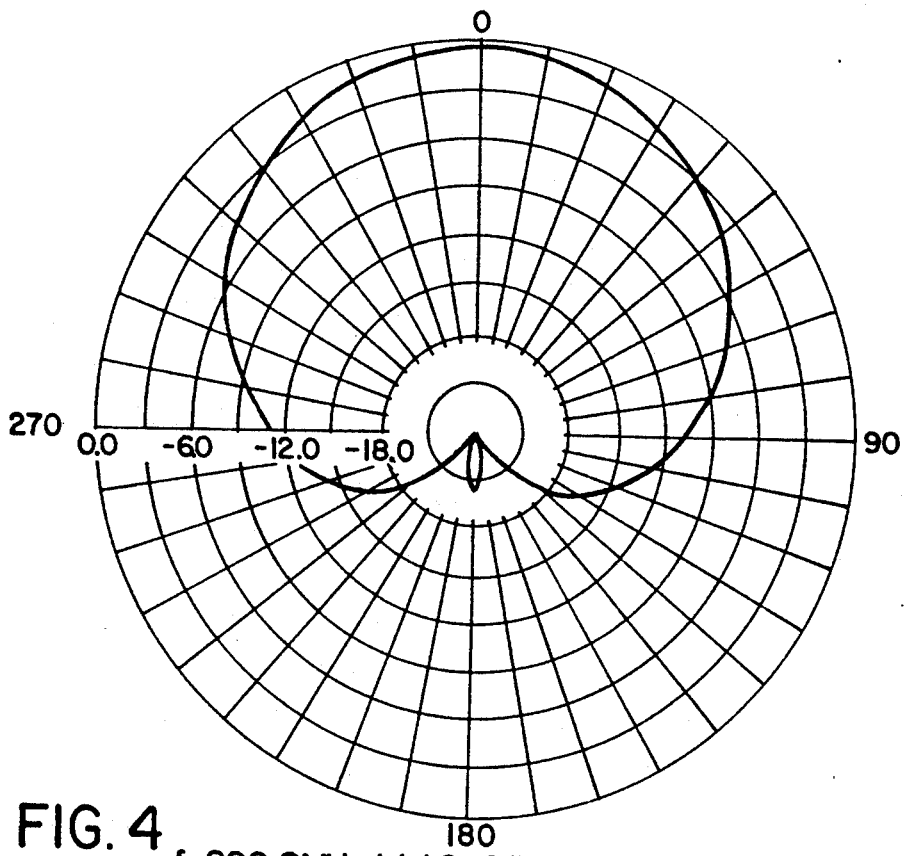
Figure 5:
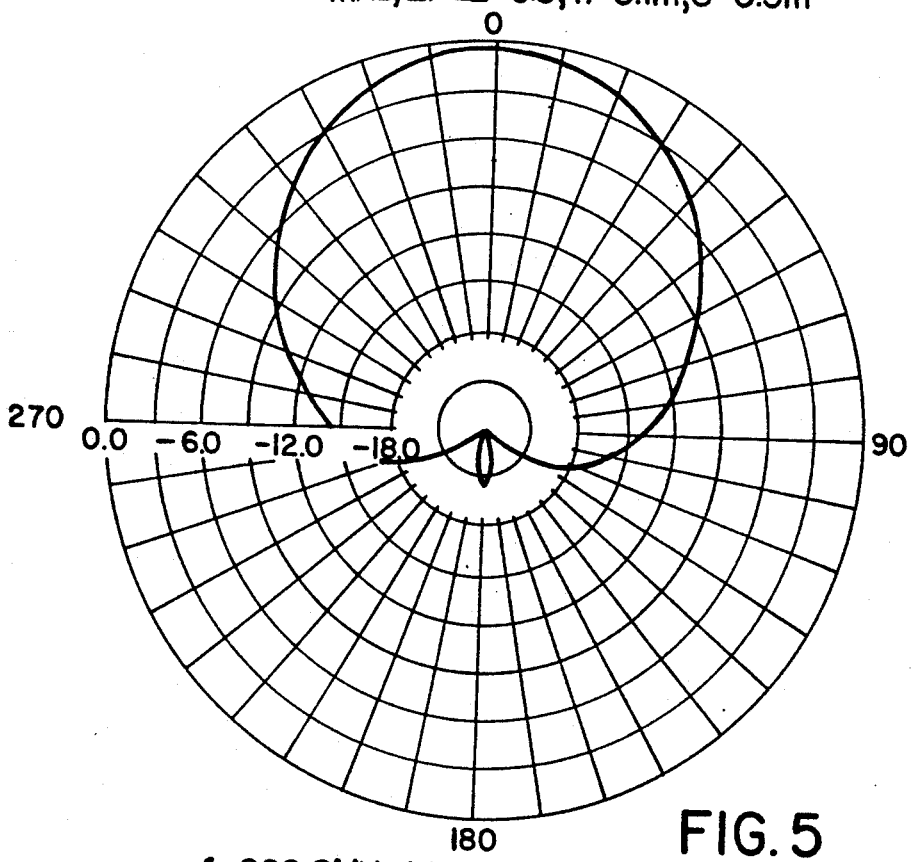

FIGS. 3 to 5 illustrate computer generated solutions to the scattering approach for various dimensions.

In particular, to illustrate the horizontal pattern, the frequency and distance S of the source 26 from the surface 10 are assumed to be fixed and the source 26 is assumed to be midway between the panels 12 and 14 so that L1 equals L2. The distance h by which the side panels 12 and 14 extend in front of the surface 10 is varied.

The effect in narrowing the radiation pattern as h increases is clearly evident.

Thus it is apparent that there has been provided in accordance with the invention a sectoral reflector antenna that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention is:

1. A field adjustable sectoral antenna comprising:

a flat reflecting surface having a front surface and first and second sides;

at least one radiating element mounted in front of said front surface; and a pair of side panels each having front and rear edges and inner and outer surfaces;

and mounting means for mounting said panels with said inner surfaces along respective ones of said first and second sides of said reflecting surface for field selective forward and rearward sliding movement of said side panels relative to said reflecting surface.

2. A field adjustable sectoral antenna comprising:

a flat reflector having a front surface and first and second sides;

at least one radiating element mounted in front of said front surface;

a pair of side panels having inner and outer surfaces and forward and rearward edges; and mounting means for mounting said side panels on said reflector such that the inner surfaces of said panels lie along respective ones of said sides of said reflector on lines parallel to and intermediate said forward and rearward edges;

and wherein said panels when installed in the field are selectively moveable forwardly and rearwardly of said front surface of said reflector.

3. The antenna of claim 2 wherein said side panels are mounted at 90° to said front surface.

4. The antenna of claim 2 wherein said mounting means comprises means enabling said side panels to slide rearwardly and forwardly relative to said front surface of said reflector.

5. The antenna of claim 4 wherein said mounting means, enables said side panels to slide rearwardly and forwardly without detachment from said reflector.

6. The antenna of claim 4 wherein said reflector includes slide members thereon and said side panels include guide means thereon, and wherein said guide means are adapted to slide over said slide members for fixing the relative position of said guide members relative to said slide members.

7. The antenna of claim 6 wherein said slide members comprise at least partially threaded studs, said guide members comprise slots, and said mounting means includes nuts to be tightened over said slots on said studs to selectively secure said panels in position.

8. The antenna of claim 6 wherein said slide members include means enabling said guide means to be fixed at preselected positions along said slide members.

9. The antenna of claim 8 wherein said means enabling comprises recesses in said slide members for selectively securing said guide members in said slide members.

10. The antenna of claim 9 wherein said recesses are placed to correspond to positions of said side panels relative to said front surface which will provide horizontal patterns of said antenna of 60°, 90° and 120°.

11. The antenna of claim 2 wherein said radiating element is a dipole.

12. A field adjustable sectoral antenna comprising:

a flat reflecting surface having a front surface and first and second sides;

at least one radiating element mounted in front of said front surface; and a pair of side panels each having front and rear edges and inner and outer surfaces;

and mounting means for mounting said panels with said inner surfaces along respective ones of said first and second sides of said reflecting surface for field selective forward and rearward sliding movement of said side panels relative to said reflecting surface;

and wherein said mounting means comprises slide members comprising at least partially threaded studs on said reflecting surface;

and guide members comprising slots in said side panels for sliding over said slide members for fixing the relative position of said guide members relative to said slide members;

said mounting means further comprising nuts for tightening on said studs over said slots and against said side panels.

13. A field adjustable sectoral antenna comprising:

a flat reflecting surface having a front surface and first and second sides;

at least one radiating element mounted in front of said front surface; and a pair of side panels each having front and rear edges and inner and outer surfaces;

and mounting means for mounting said panels with said inner surfaces along respective ones of said first and second sides of said reflecting surface for field selective forward and rearward sliding movement of said side panels relative to said reflecting surface;

and wherein said mounting means comprises slide members on said reflecting surface and guide members on said side panels, said guide members for sliding over said slide members for fixing the relative position of said panels to said reflecting surface; and slide members further comprising means for fixing preselected positions for said guide members along said slide members.

14. The antenna of claim 13 wherein said fixing means comprises recesses in said slide members for selectively securing said guide members in said slide members.

15. The antenna of claim 14 wherein said recesses are placed to correspond to positions of said side panels relative to said front surface which will provide horizontal patterns of said antenna of 60°, 90° and 120°.

16. The antenna of claim 13 wherein the position of each said pair of side panels, forwardly and rearwardly relative to said reflecting surface, is adjustable independently of the other of said pair.

* * * * *